US007416337B2

(12) United States Patent
Munch-Fals

(10) Patent No.: US 7,416,337 B2
(45) Date of Patent: Aug. 26, 2008

(54) BAG

(75) Inventor: Preben Munch-Fals, Gentofte (DK)

(73) Assignee: Jactech ApS, Soeborg (DK)

( * ) Notice: Subject to any disclaimer, the term of this patent is extended or adjusted under 35 U.S.C. 154(b) by 119 days.

(21) Appl. No.: 11/210,474

(22) Filed: Aug. 23, 2005

(65) Prior Publication Data

US 2005/0276523 A1 Dec. 15, 2005

Related U.S. Application Data

(63) Continuation of application No. PCT/DK2004/000126, filed on Feb. 25, 2004.

(60) Provisional application No. 60/509,197, filed on Oct. 6, 2003.

(30) Foreign Application Priority Data

Feb. 25, 2003 (DK) ..... 2003 00287

(51) Int. Cl.
*B65D 33/02* (2006.01)
*B65D 33/00* (2006.01)

(52) U.S. Cl. ..... 383/34; 363/34.1; 363/35

(58) Field of Classification Search ..... 383/34, 383/34.1, 33, 35; 248/99, 100, 101
See application file for complete search history.

(56) References Cited

U.S. PATENT DOCUMENTS

| | | | | |
|---|---|---|---|---|
| 1,277,327 A | | 8/1918 | Lundqvist | |
| 1,468,709 A | * | 9/1923 | La Grandeur et al. | 294/1.1 |
| 2,150,627 A | | 3/1939 | Lieber | 150/10 |
| 3,189,253 A | | 6/1965 | Mojonnier | 229/66 |
| 4,867,576 A | | 9/1989 | Boyd | 383/33 |
| 4,948,266 A | * | 8/1990 | Bencic | 383/34 |
| 5,174,658 A | | 12/1992 | Cook et al. | 383/33 |
| 5,609,419 A | | 3/1997 | Byers, Jr. | 383/33 |
| 6,164,821 A | * | 12/2000 | Randall | 383/34 |
| 6,164,826 A | * | 12/2000 | Petkovsek | 383/210.1 |
| 6,345,911 B1 | * | 2/2002 | Young et al. | 383/6 |
| 6,641,187 B2 | * | 11/2003 | Hsu | 294/1.1 |
| 2001/0037627 A1 | | 11/2001 | Hausslein | 53/455 |
| 2002/0154835 A1 | * | 10/2002 | Galomb | 383/10 |
| 2003/0009858 A1 | | 1/2003 | Goldberg et al. | 24/30.5 |

FOREIGN PATENT DOCUMENTS

| | | |
|---|---|---|
| BE | 1006052 | 5/1994 |
| DE | 25 35 744 | 8/1975 |
| DE | 2912111 | 3/1979 |
| DE | 30 22 375 A1 | 6/1980 |
| FR | 2685909 | 7/1993 |
| FR | 2822136 | 9/2002 |
| GB | 2 311 275 A | 9/1997 |
| WO | WO 00/69738 | 11/2000 |
| WO | WO 01/74631 A1 | 10/2001 |

* cited by examiner

*Primary Examiner*—Jes F Pascua
(74) *Attorney, Agent, or Firm*—Winston & Strawn LLP

(57) ABSTRACT

A bag, for e.g. collecting garbage or freezing foods, includes a thin, flexible material, e.g. plastic foil formed with an opening, which in its flat-laid state is bounded by two facing edges. A flexible stiffener made of plastic or a similar material is attached along each of these edges. The two stiffeners are connected with a foil hinge at their ends. The bag is furthermore provided with means to bend the stiffeners in a direction opposite to each other. A single operator, without the risk of soiling his or her fingers, can quickly and easily fill the bag.

16 Claims, 6 Drawing Sheets

BAG

CROSS-REFERENCE TO RELATED APPLICATIONS

This application is a continuation of International Application PCT/DK2004/000126 filed Feb. 25, 2004, and claims the benefit of U.S. provisional application 60/509,197 filed Oct. 6, 2003. The entire content of each application is expressly incorporated herein by reference thereto.

FIELD OF THE INVENTION

The present invention relates to a bag of the type composed of a thin flexible material, e.g. plastic foil, formed with an opening, which in the laid flat condition is bounded by two facing edges, one or more stiffeners made of plastic or a similar material attached to or integrated into either in part or fully along each of the edges, the material, the dimensions, and the geometry of the stiffeners being chosen such that they are sufficiently stiff to hold the bag in an open state where the bag can be filled, and sufficiently flexible to let themselves be moved or bent to a state where the bag assumes this state, at least one hinge as e.g. a foil hinge which interconnects the stiffeners, and means to bend or move the stiffeners in directions opposite to each other.

BACKGROUND OF THE INVENTION

Bags are used in large quantities for, e.g. collecting garbage or freezing food. These bags are typically made of plastic foil. Because of the thinness and the high flexibility of the plastic foil, bags of this material are difficult to hold open while they are being filled. Filling a bag therefore takes a disproportionately long time. In addition the operator risks spilling, soiling the outside of the bag or the fingers of the hand holding the bag, especially when a fluid or viscous product is to be filled into the bag. Finally there is a risk of contaminating the inside of the bag, if it is touched by dirty fingers which is often the case, since the opening end of bags often tends to get folded inside and out a couple of times in order to strengthen and maintain an opening.

Therefore, in many cases, two people must help each other to successfully fill a bag, one to hold the bag open and one to fill the bag. In this manner, the risk of spilling and getting messy fingers by the content being filled in the bag is minimized. However, there is still a risk of contaminating the content to be filled into the bag by dirty fingers and the combined time consumption for filling the bag tends to be large.

DESCRIPTION OF THE PRIOR ART

There have been attempts to solve the problem with separate frames to hold the bag open while it is being filled. In this way, the operator has both hands free to quickly fill the bag. The above named risk of spilling, soiling fingers or contaminating the content in the bag is simultaneously minimized or eliminated. These advantages are offset by the disadvantage that it takes a relatively long time to get the frame out when it is to be used and put the frame away after use. Even though the operator has such a frame, it is therefore seldom or almost never used if just one or a few bags are to be filled, which is the case most often.

From, for example, U.S. Pat. Nos. 4,023,842 and 5,913,496 are known such separate frames to hold a bag open while it is being filled. These frames take up space when they are not in use and they are difficult and time consuming to fit in the bags opening. Furthermore there seems to be proportionality in the sense that the better and tighter the frame fits and supports the bag the harder it is to remove the bag after use—which is quite unfortunate and uncomfortable.

Other bags are known which incorporate stiffeners in the edges of the bag to help hold the bag open during filling. One example of such a bag is provided by DE patent application 2,912,111. The bag provided by that patent application comprises a plastic bag with a stiffener along each edge of the bag. The stiffeners are connected at one end and are manufactured such that they bend outwards at their unconnected end thereby holding the bag open. When it is desired to close the bag, the stiffeners are pressed together and locked together via a locking mechanism integrated into the stiffeners.

Another bag of this kind is known from U.S. Pat. No. 5,609,419. The bag provided by that patent is used by climbers for carrying chalk powder. A stiffener formed as an arc is attached to each edge of the bag. One of the stiffeners is quite rigid and the other stiffener is more flexible. In closed position, the two stiffeners lie next to each, thereby forming the edge of the bag into an arc. When it is desired to open the bag, the user pulls on one of two tabs connected to the more flexible stiffener, thereby pulling the flexible stiffener away from the rigid stiffener. In this way, the bag opens and assumes a circular opening.

A third such bag is known from FR patent application 2,822,136. This bag is similar to that provided by U.S. Pat. No. 5,609,419. In FR patent application 2,822,136, the more flexible stiffener is pushed away from the rigid stiffener by applying pressure to two arms, one located at each end of the flexible stiffener. As in U.S. Pat. No. 5,609,419, in closed position, the edge of the bag is formed into an arc.

SUMMARY OF THE PRESENT INVENTION

The purpose of the current invention is to provide a bag of the art named in the introduction, which, without the use of a separate helping tool such as a frame, quickly and easily allows itself to be filled by a single operator in such a way that the risk of spilling, getting messy fingers by the content being filled in the bag, or contaminating the content to be filled into the bag by dirty fingers is eliminated or minimized.

Another purpose of the current invention is to provide a bag of the art named in the introduction, which can be easily held open by an operator using a single hand. In addition, it is desired to provide a bag which does not occupy much space when empty.

According to the invention this is achieved in that the means to move or bend the stiffeners comprises two arms, each arm being connected to at least one stiffener, said arms allowing a moment to be applied to the stiffeners about a point at, or at a short distance from, one of said at least one hinges. Note that the means to move or bend the stiffeners could also comprise more than two arms. Two arms is just one practical embodiment.

In this way, the need for a separate frame to hold the bag open while it is being filled is eliminated. The stiffeners which hold the bag open in their outwardly bent state, and which are attached to or integrated into the bag now solve this job advantageously.

In addition, since the moment to bend the stiffeners is generated by the operator pressing on arms attached to the stiffeners, there is no need for the stiffeners to be pre-formed in a curved shape. In much of the prior art, of the type providing a bag which holds itself open, the stiffeners are pre-curved. This makes the bag difficult to store. Pre-curvature of the stiffeners also introduces stresses into the material of the stiffeners under storage which can result in fatigue and/or creep. This reduces the useable lifetime of bags with pre-curved stiffeners. Pre-curvature also limits the choice of materials. According to the current invention, when the operator stops pressing on the arms, the stiffeners can bend back and assume a straight form.

Moreover, the bag according to the invention allows itself to be filled by a single operator in such a way that the risk of spilling, getting messy fingers by the content being filled in the bag, or contaminating the content to be filled into the bag by dirty fingers is eliminated or minimized.

To obtain a bag, which securely holds itself open during filling and is also optimally inexpensive to produce, the material to produce the stiffeners and the geometry and the dimensions of these is to be chosen such that they are sufficiently stiff to be able to hold the bag in an open state where the bag can be filled, and sufficiently flexible to let them be bent to a configuration where the bag assumes this state.

In a first embodiment of the bag according to the current invention the arms can in a starting position in which the bag is closed, stretch out along the corresponding stiffener in the direction of its opposite end, and in an ending position, where the bag is open, stretch out alongside one another.

Each arm can be pivotably connected to the corresponding stiffener via a hinge, e.g. a foil hinge, which allows the arm to freely pivot from the starting position to a predetermined angular position, where the arm engages with the stiffener so that further pivoting of the arm towards the end position results in bending of the stiffener at, or at a distance from, one end of the stiffener and at a predetermined angle between the arm and its' stiffener, the arm can be prevented from pivoting further relative to the part of the stiffener it is connected to so that a moment can be applied around a hinge between the stiffeners to which said arms are connected. This allows for a compact storage position for the arms.

In one embodiment the moment applying connection can be a flexible or articulated strap, which connects to an area on respectively the arm and the stiffener at a distance from the hinge between the stiffeners and the hinge between the arm and the stiffener. When the strap is taut, it produces, together with the foil hinge, a moment arm, which defines the predetermined angular position at which the arm can transfer a moment to the stiffener. With help of this solution a relatively large moment can be applied between the arm and the stiffener.

In another embodiment, the ends of the arms and the stiffeners are formed such that they push against each other when the arm has reached a predetermined angular position, and therefore the arm can transfer a moment to the stiffener. In this position, the foil hinge together with said end surfaces produce a moment arm to transfer the desired moment between the arm and the stiffener. This solution is relatively simple and cheap.

When the arms stand in their end position, they can be advantageously used as a handle to comfortably carry the bag while it is being filled. The arms can be formed with locking means, for example, one or more lockable snap fasteners to hold the arms together in the end position, after which the bag is easier to handle.

In another embodiment of the bag according to the current invention means to bend, the hinge about which a moment is applied to the stiffeners can simply be memory in the plastic or be formed at an angle to the stiffeners are made of, so that they assume a curved configuration when unloaded and thereby are holding the bag open. In this way, the arms can be placed at an angle to the stiffeners.

The stiffeners can additionally be formed with a known locking mechanism in the form of a groove on one stiffener and a complementary rib on the other stiffener. When the stiffeners are pressed together the locking mechanism is locked and the stiffeners are held together. In this closed state the bag doesn't fill more than necessary, for example during transport and storage. In addition the locking mechanism can be used to seal a bag, for example a freezer bag, when it has been filled with a product, which is to be frozen.

It is also possible that one of the many currently available bag sealing and/or closing means, such as ZIPLOC™, can be integrated into the bag. In addition, the stiffeners can be arranged such that when a moment is applied around the hinge, the locking and/or sealing mechanism is unlocked/unsealed. In this way, it is easier to open the locking and/or sealing mechanism using just one hand.

The stiffeners could also be composed of more than one piece, interconnected by hinges, such as e.g. foil hinges. This means that the stiffener can assume a discontinuous configuration when the bag is opened, consisting of both curved and straight sections.

In addition, the arms need not be attached directly at the end of the stiffeners, they could also be placed anywhere along the length of the stiffener. In this way it is possible to separate and open just a part of a distance where the stiffeners face each other.

BRIEF DESCRIPTION OF THE DRAWINGS

The current invention is described in more details below, in that example embodiments are described with reference to the accompanying drawings, where.

DETAILED DESCRIPTION OF PREFERRED EMBODIMENTS

The description below is based upon an example embodiment of the bag according to the invention, which in this case has only one stiffener extending along each of the two edges of the bags opening, said stiffeners being interconnected at their ends by foil hinges.

Figure 2:
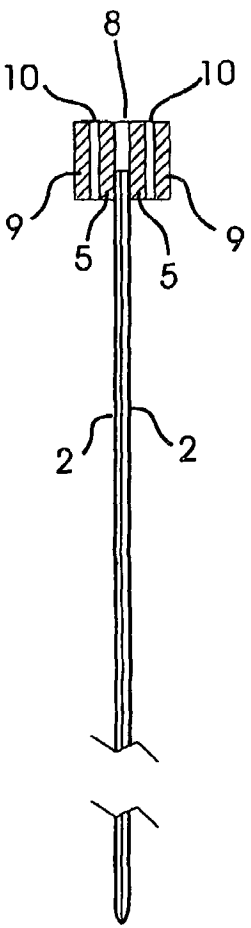
FIG. 2 shows the same, seen in section according to the line II-II in FIG. 1.
Figure 1:
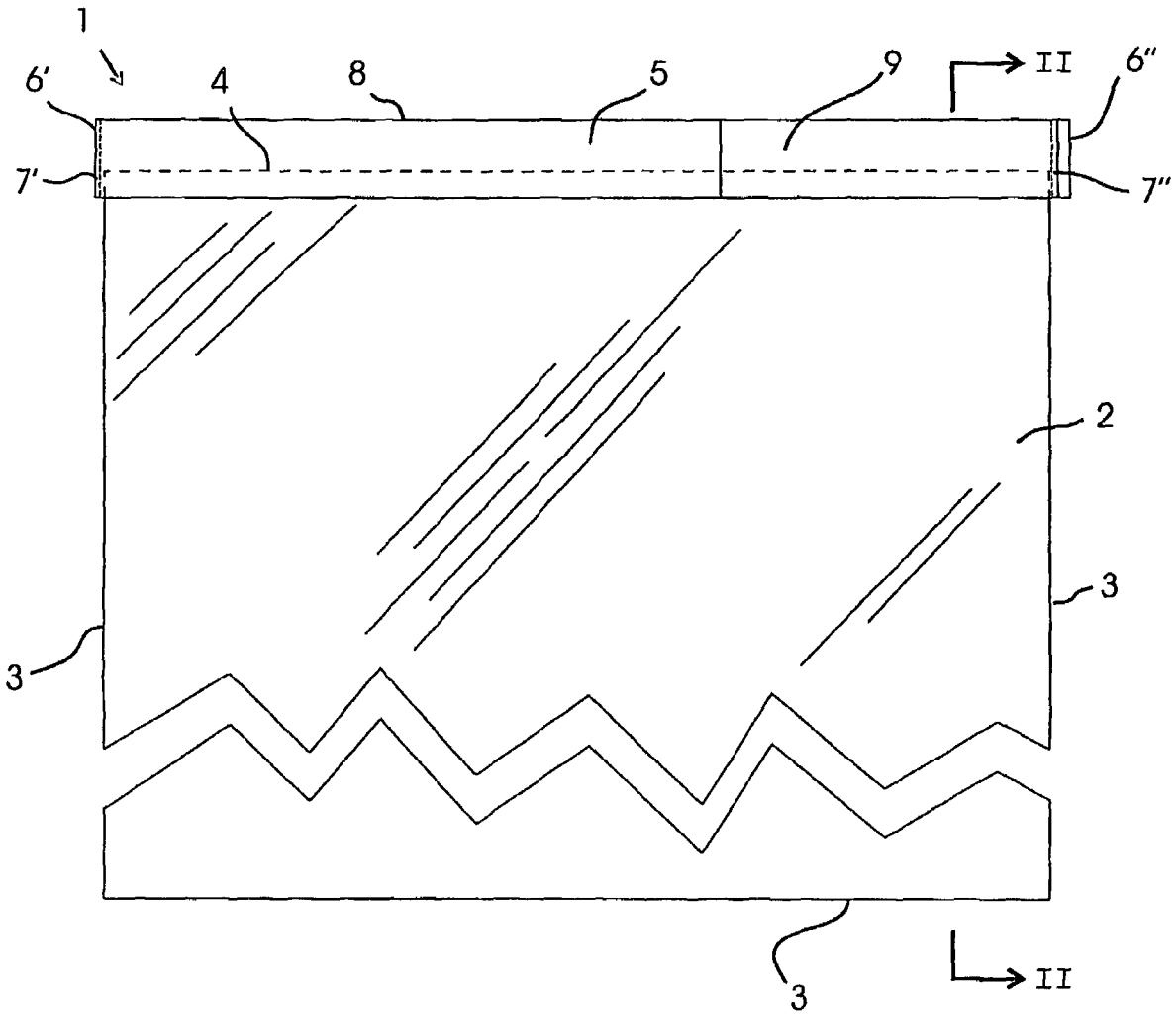
FIG. 1 shows in fragments, seen from the side, a first embodiment of a bag according the invention with stiffeners along the edges of the bag's opening and arms to bend the stiffeners.

FIGS. 1 and 2 show a first embodiment of a bag according to the present invention. The bag 1 is in this case made of two rectangular sheets of thin plastic foil 2 joined together at three edges 3 and open at a fourth edge 4. Bags of this type are used in many different applications such as e.g. packing refuse and freezing food. However, due to the thin and very flexible foil material, the bags are difficult to hold open.

A stiffener 5 is therefore attached along the open edge 4 of the two plastic foil sheets 2 by means of e.g. welding or gluing. The stiffeners 5 are joined together at their ends 6' and 6" with foil hinges 7' and 7". This gives stiffness to the opening 8. When a bending moment is applied to the stiffeners about one hinge 7' or 7" the stiffeners 5 are bent into a curved configuration, thereby holding the bag open.

In order to apply a bending moment to the stiffeners 5, an arm 9 is attached to one end 6" of each stiffener 5 with a foil hinge 10. The arms 9 can be pivoted in around the foil hinges 10 so that they extend along the stiffeners 5.

It is noted that the arms also can be attached to the stiffeners by means of foil hinges at a distance from the ends of the stiffeners and moreover can form an angle with the stiffeners (not shown).

Figure 3:
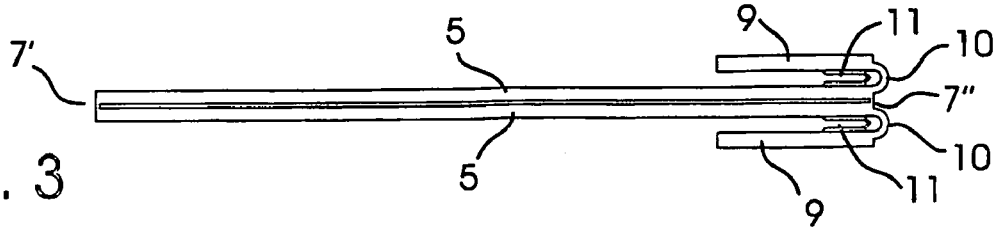
FIG. 3 shows, seen from above, the bag shown in FIG. 1 and 2, in a start position with a mechanism to transfer the moment between the arms and the stiffeners.
Figure 4:
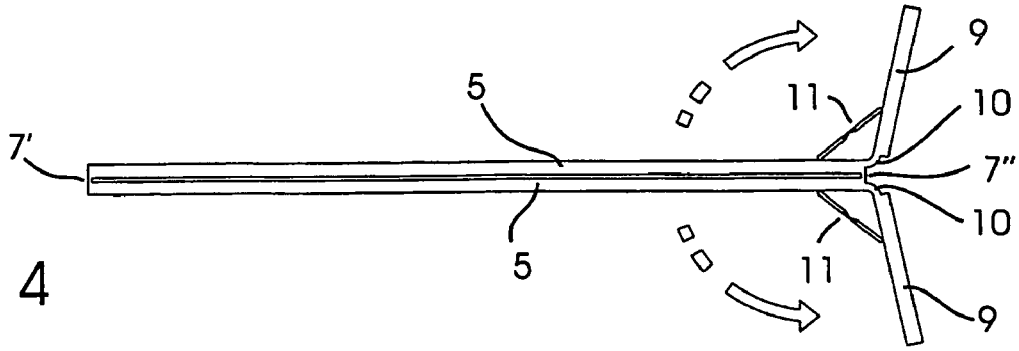
FIG. 4 shows the same with the arms pivoted to the angular position where the moment now can be applied.
Figure 5:
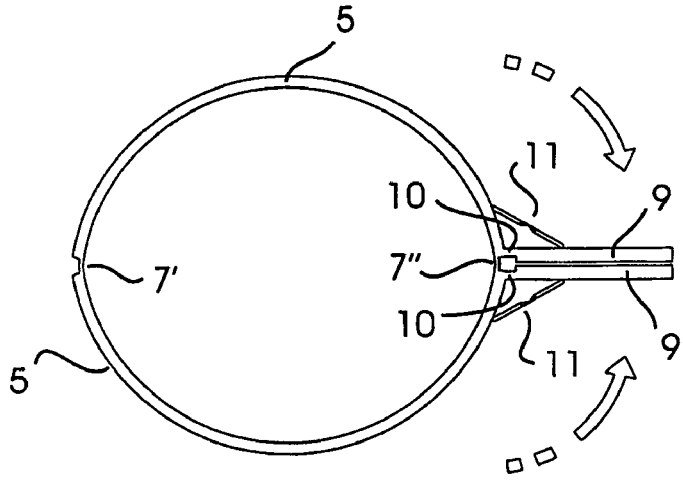
FIG. 5 shows the same with the arms pivoted to an end position where the applied moment has bent the stiffeners.

As shown in FIGS. 3-5, the arms 9 can be pivoted around the foil hinges 10, away from the stiffeners 5. A flexible strap 11 is attached between the arms 9 and the stiffeners 5. When the angle between the arms 9 and the stiffeners 5 reaches a predefined value the strap 11 becomes taut and a bending moment provided by the taut strap and the foil hinge 10 is applied to the stiffeners 5 around the foil hinge 7". As the arms 9 are pivoted more, the moment applied to the stiffeners 5 forces the stiffeners 5 to bend out and away from each other. Since both ends of the stiffeners 6' and 6" are connected via a foil hinge 7' and 7", the stiffeners 5 assume a curved shape such as e.g. an approximately circular shape as shown in FIG. 5.

Figure 6:
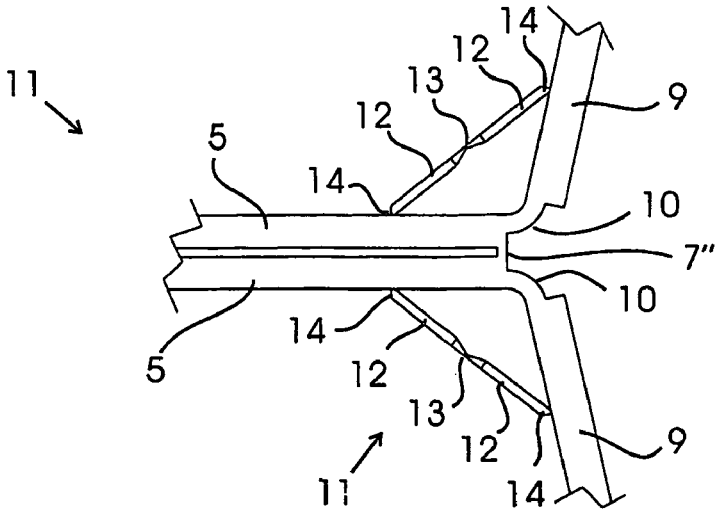
FIG. 6 shows a detailed view of one embodiment of the straps connecting the arms and the stiffeners.
Figure 7:
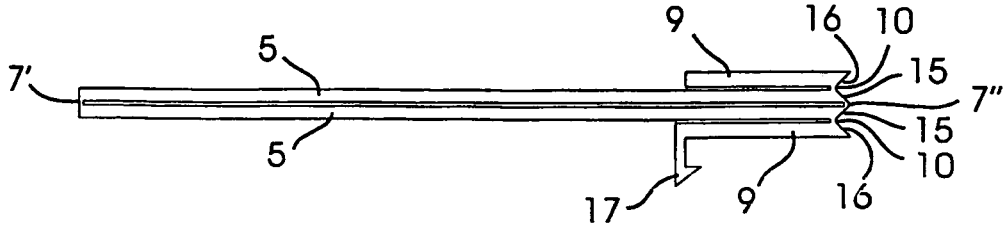
FIG. 7 shows, seen from above, the bag shown in FIG. 1 and 2, in the start position with an alternative mechanism to transfer torque between the arms and the stiffeners.
Figure 8:
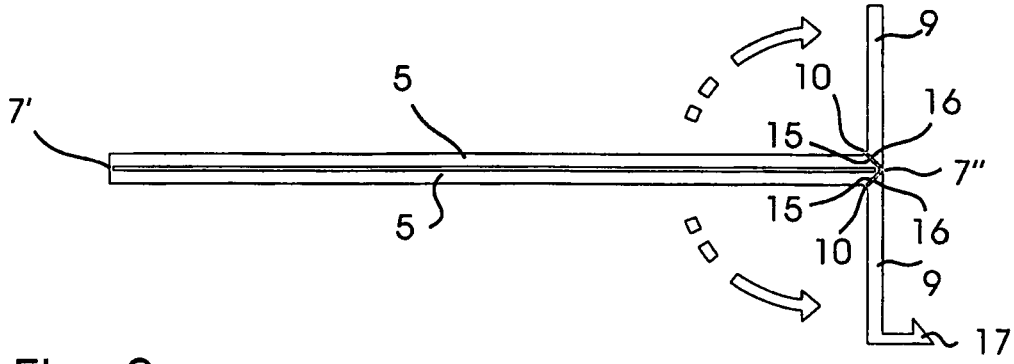
FIG. 8 shows the same with the arms pivoted to the angular position where the moment is applied.

There are many possible embodiments of the strap 11. A possible embodiment is shown in FIG. 6. In this embodiment each strap 11 is composed of two plastic links 12 joined together by a foil hinge 13. The two plastic links 12 are in a distance from the foil hinge 10 joined to the arm 9 and stiffener 5, respectively via two foil hinges 14. When the arms 9 are folded along the stiffeners 5, the strap will fold in half. Another embodiment for the strap 11 is a thin flexible band or string of plastic or a similar material.

To provide extra strength, the straps can be formed in different ways. For example, two straps can be used on each arm, one placed over the other. In this case, the top strap will be in tension and the bottom strap will be in compression.

FIG. 7-10 shows a variant of the bag shown in FIG. 1-6. For identical parts therefore the same reference numerals are used as in FIG. 1-6. In this variant, the end surface 16 of the arms 9 and the end surface 15 of the stiffeners 5 are formed so that, at a predefined angle between the arms 9 and the stiffeners 5, the end surface 16 of the arms 9 make contact with the end surface 15 of the stiffeners 5. As force is applied to the arms 9, these apply a bending moment to the stiffeners 5 provided by said contacting end surfaces and the foil hinge 10.

Figure 9:
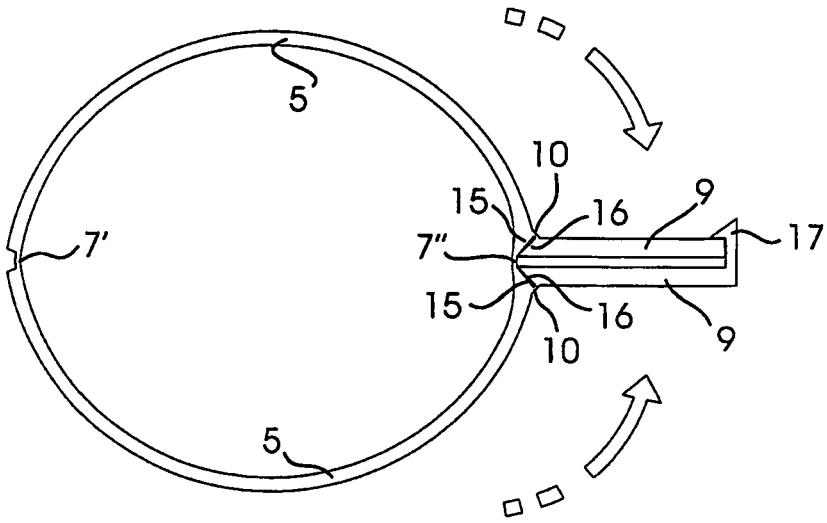
FIG. 9 shows the same with the arms pivoted to the end position, where the applied moment has bent the stiffeners.
Figure 10:
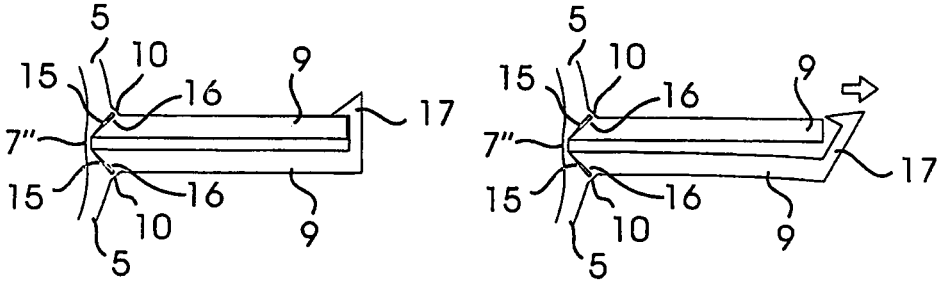
FIG. 10 shows a detail of the fastening mechanism used to lock the arms together in the open state of the bag.

As the bending moment is applied around the foil hinge 7", the stiffeners bend away from each other and assume a curved configuration such as e.g. the circular shape shown in FIG. 9.

In order to make the bag 1 more user-friendly, the arms 9 can have an integrated fastening mechanism to hold the arms 9 together in the end position once the stiffeners 5 have been bent into their curved shape and the bag 1 is held open. The fastening mechanism can e.g. be a hook 17, which is mounted on one of the arms and engages the opposite arm in the open position of the bag. The arms can even by one hand easily be disconnected again by bending the hook away from the opposite arm.

Figure 12:
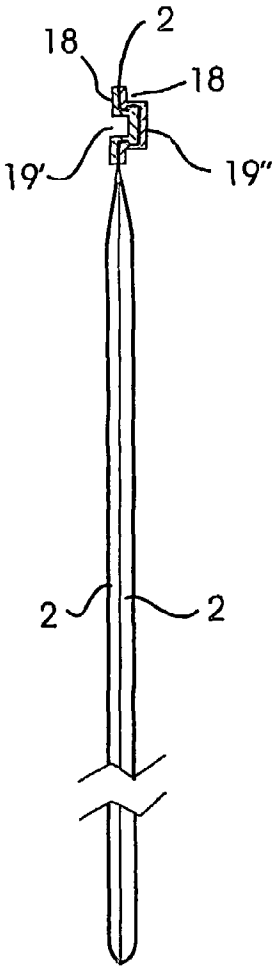
FIG. 12 shows the same, seen in section through the line X-X in FIG. 11.
Figure 11:
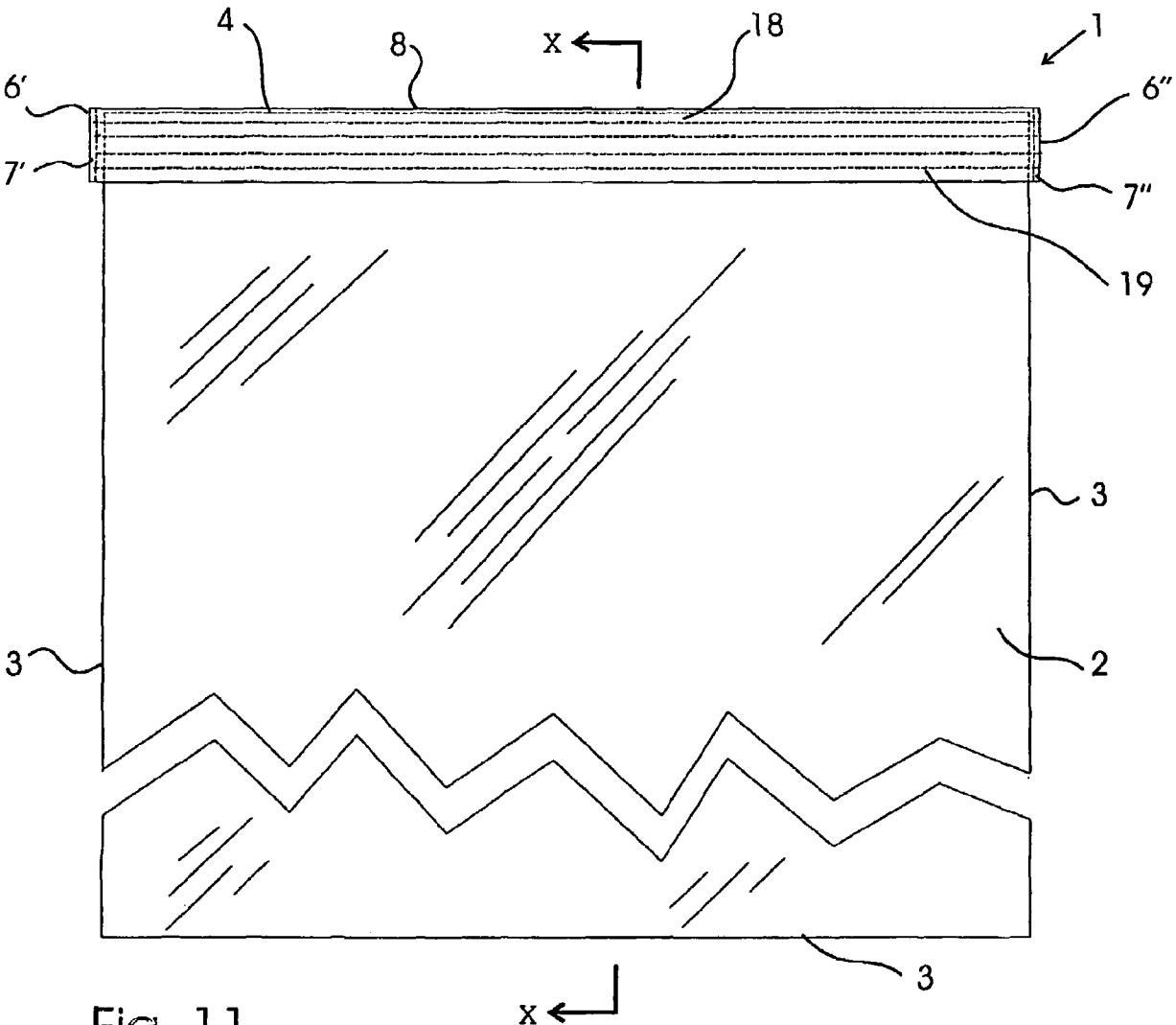
FIG. 11 shows in fragments, seen from the side, a second embodiment of the bag according to the invention with stiffeners attached along the edges of the bag's opening, note that the arms are not shown in order to simplify the drawing.

FIGS. 11 and 12 show a second embodiment of a bag according to the present invention. The bag 1 shown in FIGS. 11 and 12 is in principal constructed in the same way as the bag shown in FIGS. 1-10. The arms are not shown in order to simplify the drawing. However, the stiffeners 18 are now integrated with a locking mechanism 19. Said locking mechanism 19 consists of a male part 19' and a female part 19" which when engaged seal the bag and hold the stiffeners 18 together. As in the bag shown in FIGS. 1 and 10, the stiffeners 18 are attached to the bag along the top edge 4 of the bag. A section view of the bag 1, according to section line X-X in FIG. 11, with the locking mechanism 19 engaged is shown in FIG. 12.

The locking mechanism 19 presented in the second embodiment of the bag 1 can be used to close and seal the bag once it has been filled. This is useful in applications such as e.g. food freezing. By using said locking mechanism instead of the traditional knot for sealing the bag it is further obtained that the bag can be shorter, thereby advantageously saving plastic foil during the manufacturing of the bag. Locking mechanisms of the kind shown in FIG. 11-12 are known in many different embodiments. A very well known type is ZIPLOC™. The bag according to the current invention can be used with any of these commonly known locking mechanisms.

Some operators prefer to cut the stiffeners 18 off the bag and close the bag 1 via e.g. a traditional knot. In this case, the locking mechanism 19 can be one or more snap fasteners.

Figure 13:
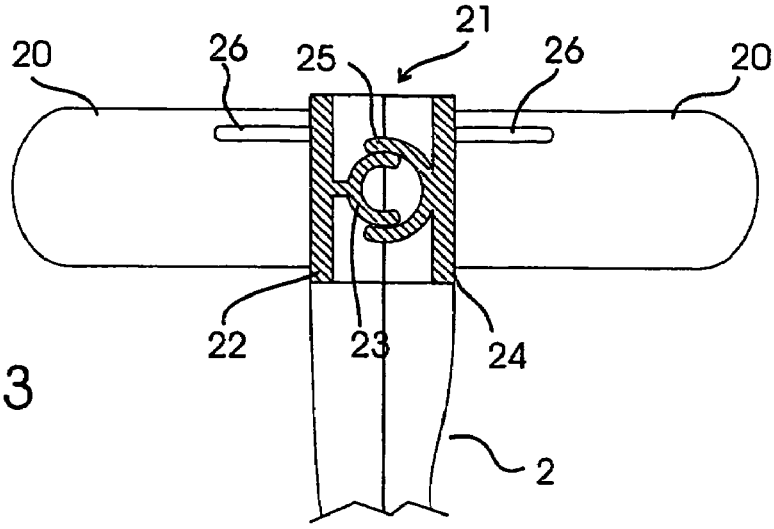
FIG. 13 shows an end view of a third embodiment of a bag according to the invention with a sealing and opening mechanism in a first state.
Figure 14:
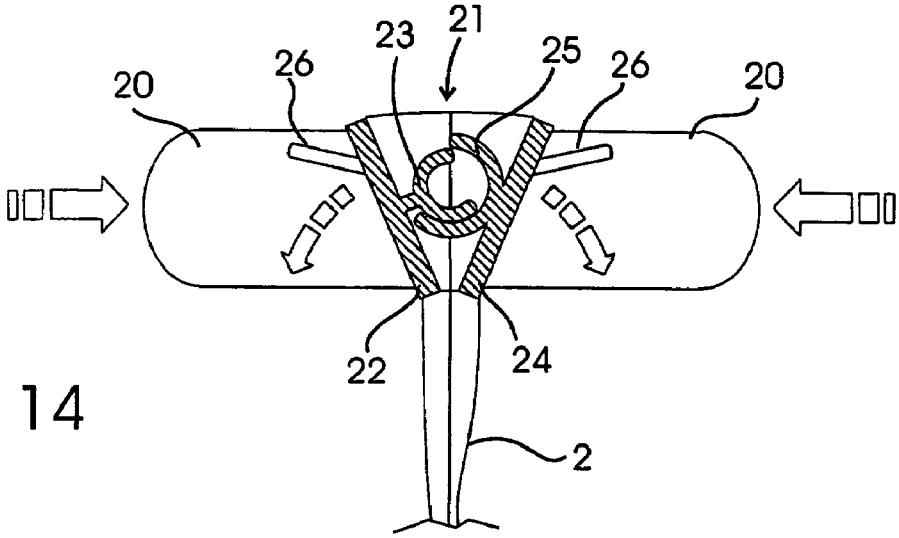
FIG. 14 shows the same, in a second state.
Figure 15:
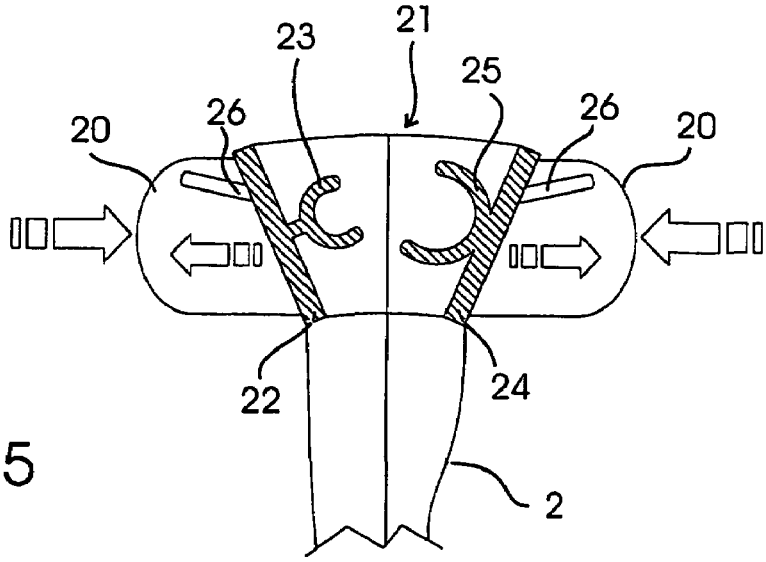
FIG. 15 shows the same in a third state.

FIG. 13-15 show a way in which arms 20 can be used to open a locking mechanism 21. The arms in FIG. 13-15 are similar to the arms shown in FIG. 3-6. In FIG. 13, the bag is shown in a closed position, in which the locking mechanism is engaged. The locking mechanism 21 is comprised of a first stiffener 22 with a male locking part 23 and a second stiffener 24 with a female locking part 25. Articulated straps 26, of the kind shown in FIG. 3-6, are attached to the top of the stiffeners 22,24. As the arms 20 are pressed together by the operator, the stiffeners 22,24 are rotated around the axis of the locking mechanism 21 since the articulated straps 26 are mounted to the top of the stiffeners 22,24 and not to the middle. FIG. 14 shows how the stiffeners 22,24 have been rotated and the locking mechanism 21 is about to release. And FIG. 15 shows how the locking mechanism 21 has released.

In the above example, a rotation motion was caused between the stiffeners to help open the locking mechanism. Many other methods can also be used to help open the locking mechanism. Examples being mechanisms which cause the two stiffeners to be moved linearly or twisted with respect to each other.

Figure 16:
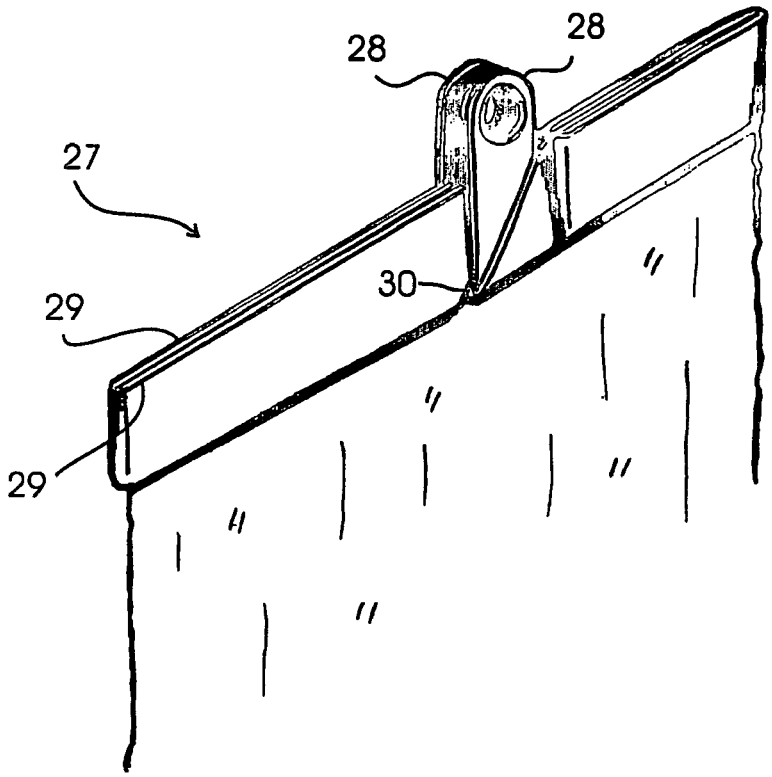
FIG. 16 shows a third embodiment of a bag according to the invention in a closed state.
Figure 17:
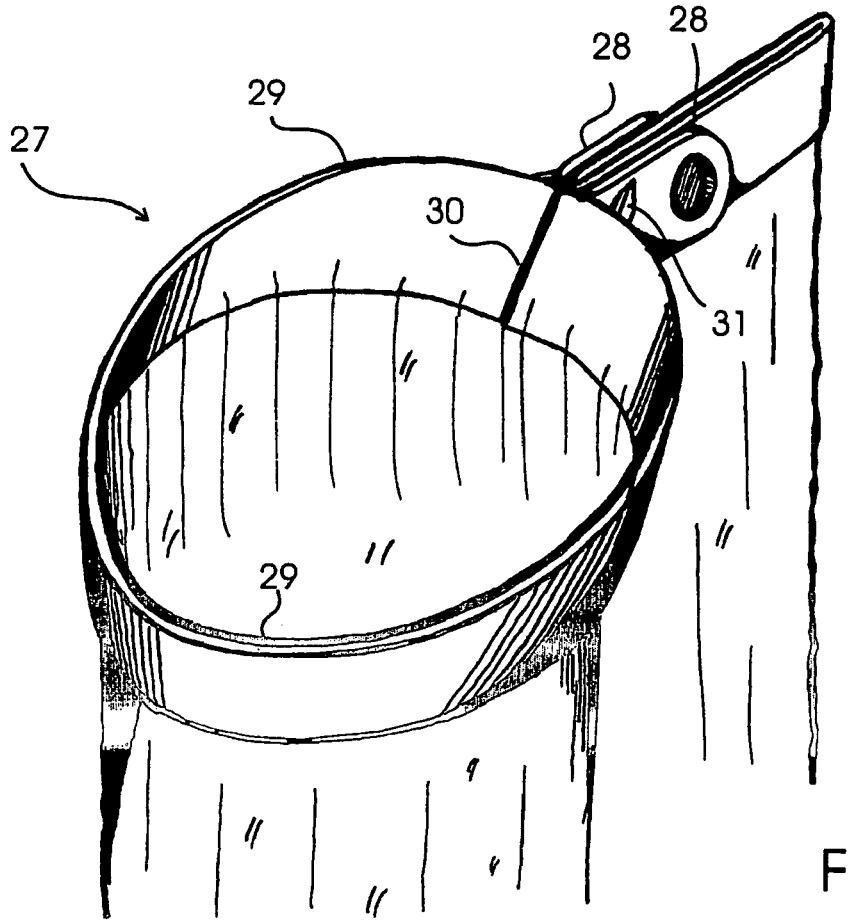
FIG. 17 shows the same in an open state.

FIGS. 16-17 show a third embodiment of a bag 27 according to the invention. In this case, the arms 28 are mounted at an angle to the stiffeners 29 at a location near the centre of the bag. The hinge 30 about which the arms 28 rotate is at an angle to the stiffeners 29. When the arms 28 are bent away from the stiffeners, articulated straps 31 of the kind described previously apply a moment to the stiffeners 29. Note that the hinge 30 does not physically connect the two stiffeners. It is just a point about which the two stiffeners pivot. In effect it acts like a hinge.

Placing the arms near the centre of the bag is useful when heavy bags are used or if an opening is required which does not span the entire width of the bag. By placing the arms near the centre of the bags, the operator holds the bag near its centre of gravity and the moment induced by the weight of the bag about the arms or holding point is therefore less. In this case the operator can also hold the bag via both the stiffeners and the arms, thereby further increasing the stability of the bag and the amount of weight which can be carried in the bag.

If very large bags are used, an arm arrangement such as shown in FIGS. 3-6 could be attached to both ends of the bag. This would ensure that both ends of the bag are properly held open and supported. A locking mechanism to lock the arms together such as was shown in FIGS. 7-10 would be useful in these cases.

Many other forms of arm mechanisms can also be imagined. An arm mechanism which goes through a deadpoint, thereby forming a toggle joint, would provide a bag with an open and shut position, thereby being very easy to operate.

The profile of the stiffeners and of the arms is described above and shown on the figures as being rectangular. Said section can, however, within the scope of the invention have any other useful form. The profile can, for example, be relatively thin, whereby the stiffness is obtained by means of ribs (not shown). In another advantageous embodiment the profile can be wavy for providing the stiffness (not shown). In both cases material is spared.

Each stiffener can also be wavy in the longitudinal direction (not shown) permitting longitudinal elongation of the stiffener whereby a bag can easily be tightened around e.g. a rubbish bin. In this way the stiffener acts as a rubber band tightening the grip about the rubbish can.

In embodiments where the stiffeners only extend partly along the edge of the opening of the bag such that a free section is left between two stiffeners, this section and/or the whole bag furthermore can advantageously be wrinkly (not shown) for thereby being able to vary the diameter of the bag at least at the opening. This could also be an advantage when placing the bag with one hand on a frame or rubbish bin.

In the above it is mentioned that the stiffeners can be welded or glued to the bag. The stiffeners can also, within the scope of the invention, be an integrated part of the edge. The stiffeners can e.g. be monolithic with the edges of the bag or the edges can be made stiff by means of e.g. UV radiation. The edges can in this case be further reinforced by being folded one or more times.

It should also be mentioned that the hinges referred to in this document can take many different forms. In addition, the hinges need not be physical connections in all cases. For example, a point where two objects which are in contact with each, rotate with respect to each other, can function and be called a hinge even if the objects are not connected with a physical hinge. In addition it should be noted that the hinges which connect the arms to the stiffeners and the hinges which connect the stiffeners together do not have to be located at the same point. Also, the arms could be connected at different points and angles on the stiffeners.

The bag according to the invention can quickly and easily be filled by a single operator in such a way that the risk of spilling, getting messy fingers by the content being filled in the bag, or contaminating the content to be filled into the bag by dirty fingers is eliminated or minimised.

Another advantage consists in that the bag according to the invention quickly and easily can be mounted and dismounted on e.g. a rubbish bin (not shown), whereby the bag assumes a stable position in the mounted state even though it is not tightly secured.

The above named, and on the drawing shown, locking mechanism can advantageously be used for sealing the bag when filled by e.g. objects to be frozen. Plastic tends, however, to creep in time when stressed, such that the locking mechanism risks becoming more or less ineffective. For solving this problem the bag can advantageously be stored in a condition where the locking mechanism is not closed and therefore is not stressed. The foil hinges can in this case be extra large for thereby allowing the stiffeners to be placed along each other and the locking mechanism easily to be in an open state (not shown).

What is claimed is:

1. A bag comprising:

a thin, flexible material formed with an opening, which in the bag's flat-laid state is bounded by two facing edges, one or more stiffeners attached to or integrated into either in part or fully along each of the edges, the material, the dimensions, and the geometry of the stiffeners being chosen such that they are sufficiently stiff to hold the bag in an open state where the bag can be filled, yet sufficiently flexible to let themselves be moved or bent to a state where the bag assumes this open state, at least one hinge interconnecting the stiffeners, and means to bend or move the stiffeners in directions opposite to each other, wherein the means comprises two arms, each arm being pivotably connected to at least one stiffener, wherein one or more connections between the arms and stiffeners allow for varying angles between them, and wherein the arms allow a moment to be applied to the stiffeners about a point at, or at a short distance from, one of the at least one hinges, by pivoting the arms.

2. The bag according to claim 1 wherein the thin, flexible material is a plastic.

3. The bag according to claim 1 wherein the stiffeners are made of plastic material.

4. The bag according to claim 1 wherein the flexible hinge is made of plastic material.

5. The bag according to claim 1, wherein the one or more connections between the arms and stiffeners is formed such that the arm is prevented from pivoting further relative to the stiffener to allow a moment to be applied around the hinge between the stiffeners to which the arms are connected.

6. The bag according to claim 5, wherein the one or more connections between the arms and stiffeners is produced by a hinge and end surfaces, which are formed on the stiffeners and the arm respectively and which push against each other when the arm reaches the predetermined angle to the stiffener.

7. The bag according to claim 5, wherein the hinge about which a moment is applied to the stiffeners is at an angle to the stiffeners.

8. The bag according to claim 1, wherein each arm has a starting position with the bag closed, where it lays mainly next to the respective stiffener, and an end position with the bag open, where the two arms stretch out mainly alongside or at an angle to one another.

9. The bag according to claim 1, wherein the stiffeners are formed with locking means.

10. The bag according to claim 9, wherein the locking means comprises a groove on one stiffener and a complimentary rib on the other stiffener.

11. The bag according to claim 9, wherein the stiffeners are arranged such that when a moment is applied around the hinge, the locking or sealing mechanism is unlocked or unsealed.

12. The bag according to claim 1, wherein a conventional bag sealing or closing means is integrated into the bag.

13. The bag according to claim 1, comprising at least one hinge that does not physically connect the stiffeners to each other.

14. A bag comprising:

a thin, flexible material formed with an opening, which in the bag's flat-laid state is bounded by two facing edges, one or more stiffeners attached to or integrated into either in part or fully along each of the edges, the material, the dimensions, and the geometry of the stiffeners being chosen such that they are sufficiently stiff to hold the bag in an open state where the bag can be filled, yet sufficiently flexible to let themselves be moved or bent to a state where the bag assumes this open state, at least one hinge interconnecting the stiffeners, and means to bend or move the stiffeners in directions opposite to each other, wherein the means comprises two arms, each arm being connected to at least one stiffener, wherein the arms allow a moment to be applied to the stiffeners about a point at, or at a short distance from, one of the at least one hinges, by pivoting the arms about that point, wherein one end of each arm is pivotably connected to a stiffener at, or at a distance from, one end of the stiffener and that at a predetermined angle between the arm and the stiffener, so that a moment producing connection is formed such that the arm is prevented from pivoting further relative to the stiffener to allow a moment to be applied around the hinge between the stiffeners to which the arms are connected, and wherein the moment producing connection is produced by a hinge and a flexible or articulated strap which is connected with an area on respectively the arm and the stiffener at a distance from the hinge, and which is taut when the arm reaches the predetermined angle to the stiffener.

15. A bag comprising:

a thin, flexible material formed with an opening, which in the bag's flat-laid state is bounded by two facing edges, one or more stiffeners attached to or integrated into either in part or fully along each of the edges, the material, the dimensions, and the geometry of the stiffeners being chosen such that they are sufficiently stiff to hold the bag in an open state where the bag can be filled, yet sufficiently flexible to let themselves be moved or bent to a state where the bag assumes this open state, at least one hinge interconnecting the stiffeners, and means to bend or move the stiffeners in directions opposite to each other, wherein the means comprises two arms, each arm being connected to at least one stiffener, wherein the arms allow a moment to be applied to the stiffeners about a point at, or at a short distance from, one of the at least one hinges, by pivoting the arms about that point, wherein one end of each arm is pivotably connected to a stiffener at, or at a distance from, one end of the stiffener and that at a predetermined angle between the arm and the stiffener, so that a moment producing connection is formed such that the arm is prevented from pivoting further relative to the stiffener to allow a moment to be applied around the hinge between the stiffeners to which the arms are connected, and wherein the arms are formed with fastening means to lock the arms together when the bag is in an open or closed state.

16. The bag according to claim 15, wherein the fastening means comprises one or more snap fasteners.

* * * * *